6/10/86 XR 4,593,761

United States Patent [19]

Hoyt

[11] Patent Number: 4,593,761

[45] Date of Patent: Jun. 10, 1986

[54] MISCIBLE OIL FLOODING AT CONTROLLED VELOCITIES

[75] Inventor: Donald L. Hoyt, Houston, Tex.

[73] Assignee: Texaco Inc., White Plains, N.Y.

[21] Appl. No.: 632,994

[22] Filed: Jul. 20, 1984

[51] Int. Cl.[4] ..... E21B 43/16

[52] U.S. Cl. ..... 166/268; 166/274

[58] Field of Search ..... 166/268, 273, 274

[56] References Cited

U.S. PATENT DOCUMENTS

| | | | |
|---|---|---|---|
| 3,209,824 | 10/1965 | Koch, Jr. et al. | 166/268 |
| 3,620,304 | 11/1971 | Hearn | 166/274 |
| 3,811,503 | 5/1974 | Burnett et al. | 166/274 |
| 4,136,738 | 1/1979 | Haynes, Jr. et al. | 166/273 |
| 4,299,286 | 11/1981 | Alston | 166/274 |
| 4,418,753 | 12/1983 | Morel et al. | 166/268 |

*Primary Examiner*—Stephen J. Novosad
*Assistant Examiner*—Bruce M. Kisliuk
*Attorney, Agent, or Firm*—Jack H. Park; Kenneth R. Priem; Harold J. Delhommer

[57] ABSTRACT

The disclosed invention is a method of conducting a miscible flood with a flooding medium predominantly composed of carbon dioxide or nitrogen in a shorter period of time with acceptable hydrocarbon recovery. The invention is practiced by injecting a predominantly carbon dioxide or nitrogen medium into the underground hydrocarbon reservoir at such a rate as to produce a frontal advance velocity in the reservoir of about 2 to about 15 times the critical velocity of flow for that flooding medium through the instant reservoir. This high flooding velocity, substantially above critical velocity, is maintained until the flooding front has traveled about 60% to about 90% of the distance from the injection to the production systems. At this time, the frontal advance velocity is reduced to a value approximately equal to or less than the critical velocity for the remainder of the miscible flood.

6 Claims, No Drawings

MISCIBLE OIL FLOODING AT CONTROLLED VELOCITIES

BACKGROUND OF THE INVENTION

This invention relates to a method of miscible flooding for enhanced oil recovery wherein the flood is conducted at flow velocities greater than the critical velocity of flow through the reservoir in order to obtain maximum hydrocarbon recovery within a reasonable period of time. This enhanced oil recovery method is especially applicable to reservoirs having a relatively small dip angle of less than about ten degrees.

The most successful miscible enhanced oil recovery floods are conducted at frontal advance velocities equal to or less than critical velocity. These are termed gravity-stable floods. Miscible floods conducted with carbon dioxide, nitrogen or light hydrocarbon components are generally operated below critical velocity since it is well known in the art that much better oil recovery can be obtained. Above critical velocity, density and viscosity differences between the displacing fluid and the displaced fluid are such that the displacing fluid will tend to finger through the fluid to be displaced in the reservoir in an erratic manner and result in a flood without substantial vertical and horizontal conformance.

Consequently, the prior art recommends miscible flooding at or below critical velocity in order to maximize oil recovery. This is recognized in U.S. Pat. Nos. 3,878,892; 4,136,738; 4,257,650; 4,299,286; 4,418,753 and 4,434,852.

A different twist on flooding at frontal velocities below critical velocity is disclosed in U.S. Pat. No. 4,136,738. In this method, a light hydrocarbon slug of $C_2$–$C_6$ aliphatic hydrocarbons is injected at a rate in excess of the critical velocity to ensure mixing of the light hydrocarbons with the reservoir oil in the area surrounding the injection well. As a result of this mixing, the reservoir oil is altered so as to form a conditionally miscible transition zone which will be miscible with subsequently injected carbon dioxide. Thereafter, carbon dioxide is injected at a relatively low rate which will produce frontal advance velocities less than critical velocity.

Some miscible floods have been conducted at frontal velocities greater than the relevant critical velocity. One example is a miscible carbon dioxide flood conducted by Shell Oil Corp. in the Little Creek Field in Mississippi, wherein the carbon dioxide velocity within the reservoir has exceeded critical velocity for the entire miscible flood. Canadian Patent No. 791,463 discloses a predominantly methane flood with added $C_2$–$C_6$ hydrocarbons conducted under miscible conditions at a velocity greater than critical velocity for the entire flood.

SUMMARY OF THE INVENTION

The present invention is a method of conducting a miscible flood with a flooding medium predominantly composed of carbon dioxide or nitrogen in a shorter period of time with acceptable hydrocarbon recovery. The invention is practiced by injecting a predominantly carbon dioxide or nitrogen medium into the underground hydrocarbon reservoir at such a rate as to produce a frontal advance velocity in the reservoir of about two to about fifteen times the critical velocity of flow for that flooding medium through the instant reservoir, as defined by the critical velocity equation discussed below.

In the practice of the invention, the advance of the miscible flooding front is maintained at a velocity approximately two to fifteen times critical velocity until the flooding front has traveled about 60% to about 90% of the distance from the system of injecting into the reservoir to the production system. At this time, the frontal advance velocity is reduced to a value approximately equal to or less than the critical velocity for the remainder of the miscible flood. This allows for the partial healing of the displacement fingers and the creation of a more uniform flood front as well as the creation of an oil bank in front of the flood front as the flood front travels the remaining 10% to 40% of the distance to the producing system. This invention is especially applicable in reservoirs having a relatively low dip angle of less than about 10 degrees where critical velocities are so low as to require uneconomical, lengthy, flooding project lives.

DETAILED DESCRIPTION

It is well known to those skilled in the miscible flooding art that much better oil recoveries can be obtained from miscible floods conducted at velocities less than a critical velocity. This is because of severe conformance problems which may arise in the displacement of the hydrocarbons by the advancing miscible flood front. The miscible displacing gas will tend to finger through the hydrocarbons in an inconsistent manner preventing the advancing flood front from building up a substantial oil bank in front of the miscible flood front. As a result, hydrocarbon recovery and productivity is substantially smaller for miscible floods conducted at frontal advance velocities greater than the critical velocity when compared to miscible floods conducted at or below the critical velocity.

The critical velocity of a miscible displacing medium through a hydrocarbon reservoir can be defined as:

$$V_c=[2.741k\Delta\rho(\sin a)]/\phi\Delta\mu,$$

wherein $V_c$ is the critical velocity in feet per day, k is the permeability of the reservoir in darcies, $\phi$ is the fractional mobile fluid porosity of the reservoir which is $\phi_r(1-S_{wr}-S_{or})$ where $\phi_r$ is the rock porosity, $S_{wr}$ is the residual water saturation, $S_{or}$ is the residual oil saturation, a is the dip angle of the reservoir in degrees, $\Delta\rho$ is the density differential between the displaced fluid and the displacing fluid in grams per cubic centimeter, and $\Delta\mu$ is the viscosity differential between the displaced fluid and the displacing fluid in centipoise.

It can be seen from the critical velocity equation that the dip of the hydrocarbon reservoir has a large influence upon the critical velocity of the displacing medium. Since "a" is the dip angle in degrees, a formation with a dip angle of 5° will have a critical velocity half that of a formation with a dip angle of 10°, and about one-sixth that of a formation with a dip angle of 30°. Consequently, relatively flat reservoirs with small dip angles to the horizontal may have critical velocities which are too low for economical project lifetimes. For example, in a certain Southeast Louisiana reservoir having a dip angle of about 6°, the distance between injecting and producing wells is nearly 2,000 feet. At a critical velocity of about 0.1 feet per day for this reservoir, the required project life of about 55 years is not economically feasible.

Recent work has unexpectedly indicated that a miscible flood can be conducted at a velocity substantially greater than critical velocity followed by a decrease to a velocity at or below critical velocity near the end of the miscible flood without a substantial loss in oil recovery efficienty. Under the method of the invention, the miscible flood is conducted with a flooding medium predominantly composed of carbon dioxide or nitrogen which is injected into the reservoir at a rate to produce a flow velocity in the reservoir of about two to about fifiteen times, preferably about three to about ten times the critical velocity of flow under those conditions. The flood is maintained at such a high velocity until the flood front has covered approximatley 60% to about 90%, preferably about 75% to about 90% of the distance between the injection system and the production system. Light aliphatic hydrocarbons such as $C_2$–$C_6$ may also be added to the flooding medium to alter miscibility properties in the amounts of about 1% to about 5% by weight.

Table I shows the pore volume injected (PVI) at gas breakthrough and the productivity from corefloods ($CO_2$ gas displacing oil), each done under the same test conditions except that the ratio of the frontal advance velocity to the critical velocity, $V/V_c$, was varied. As can be seen, the greater the ratio of $V/V_c$, the earlier the breakthrough of the injected gas and the smaller the rate of recovery per unit volume injected. This indicates that the length of the transition or mixing zone and the bypassing of oil are made worse by higher velocityies with a resultant decrease in productivity. Productivity, in terms of barrels of oil produced per day may be a more important economic factor even than ultimate recovery. However, when multiple pore volumes were injected above critical velocity, ultimate recovery increased to match the ultimate recovery below critical velocity despite the much lower productivity per pore volume injected.

TABLE I

MISCIBLE $CO_2$ FLOODS CONDUCTED AT DIFFERENT $V/V_c$ RATIOS

| $V/V_c$ | PVI at Gas Breakthrough | Producitivty: % $S_o$ per PVI |
|---|---|---|
| .7 | .40 | 57 |
| 1.4 | .35 | 29 |
| 3.3 | .10 | 20 |
| ∞ | .05 | 13 |

For the latter part of the flood, the invention method requires that the miscible flood be conducted in a gravity-stable mode with a frontal advance velocity at or below critical velocity. It is believed that this reduction to critical velocity in the latter stages of the miscible flood allows the carbon dioxide solubility and buoyant forces to reduce or heal the fingering which has already occurred by the miscible displacing medium and allow the establishment of an oil bank. Oil recovery efficiency is dramatically improved over a flood which is completely conducted at a frontal advance greater than critical velocity and the overall time required by a gravity-stable miscible flood is considerably shortened.

The percentage of distance between well systems selected for the flooding velocity change will depend upon circumstances such as spacing and the $V/V_c$ ratio required for the reservoir being considered. The governing factor is usually the time required for the injection fluid to reach the production wells. For a distance, d, between injection production wells, the time to reach the wells would be $$t = \frac{d}{V_c}\left[\frac{f}{V/V_c} + (1 - f)\right]$$

where f is the fraction of the distance d, at which the velocity will be reduced to $\leqq V_c$.

As an example, assume a reservoir in which the critical velocity is 0.25 ft/day, the distance d is 1000 ft., and the economics are such that the minimum acceptable time for the flood front to reach the production system is about 5 years or about 1825 days. If we plan to hold the $V/V_c$ ratio to 3.5 and then to reduce velocity at 60% of the distance, f=0.6, we would calculate a t=2286 days (6.3 yrs.), which is too long a period of time. We could then either raise $V/V_c$ or f, or both. The fractional distance f could be increased to 76% and a $V/V_c$ ratio of 3.5 would provide a t=1828 days, which is acceptable. If, instead, the $V/V_c$ ratio was raised to 5.0, f would have to be increased only to 68% to obtain a t=1825 days.

The advantage of raising $V/V_c$ is that production is achieved sooner, and project life is shortened, but at the cost of reduced recovery efficiency. The advantage of keeping the fractional distance "f" as low as possible is that banking of oil is facilitated and recovery efficiency improved, but at the cost of a longer time required to recover that oil.

Note, however, that it is not advisable to let f exceed 90% of d, because the distance and time remaining after velocity reduction should be enough to allow existing fingers to heal by gravity segregation. In general, the best practice of this method will be to:

(1) determine a minimum acceptable time (2) determine the combination of f and $V/V_c$ which allows reasonable time and distance for segregation during the second stage of frontal advance.

My experience teaches that times on the order of a year or more, and a distance of at least 100 feet is needed to accomplish this in the field.

With the present invention, little oil displacement will occur during the period when critical velocity is exceeded except at the tips of the irregular fingers of the advancing displacing fluid. No substantial oil bank will be formed until the latter part of the process. Most displacement is by a vaporization process in which the carbon dioxide or nitrogen strips light hydrocarbons from the formation. The miscible displacing medium literally vaporizes or forces light hydrocarbon components out of the reservoir oil and carries them along. As a result, up to 95% of the hydrocarbon recovery will be liquid condensate and as little as 5% will be displaced hydrocarbon liquids. Recovery from most hydrocarbon reservoirs is expected to be one barrel of oil per 25,000 scf+10,000 scf. Of course, the ratio of recovered liquid condensate to recovered displaced hydrocarbons will change during the later stages of the flood when an oil bank is formed and pushed toward the producing wells. At this point, the relative amount of displaced hydrocarbons will increase significantly.

Normally, oil production is expected to be highest at the start to the middle of a miscible flood and then taper off towards the end. But with the present invention, oil production is highest near the end of the flood due to the late formation of an oil bank.

If the present invention was applied to the example Southeast Louisiana reservoir mentioned above, a miscible flood could be efficiently conducted in about 15 to 20 years rather than the unacceptable time of 55 years. Employing a miscible carbon dioxide flood at a frontal advance velocity of four times critical velocity for 90% of the distance between the injection and production systems would take approximately 12.3 years. The remaining 10% of the distance could be flooded in a gravity-stable mode at critical velocity in about 5.5 years, which would allow time for the reduction of the viscous fingers and the creation of an oil bank with higher conformance. Areal sweep, displacement efficiency and vertical sweep efficiency would all be improved and the entire miscible flood could be performed in a period of 17.8 years as opposed to the economically unacceptable lifetime of 55 years.

Many other variations and modifications may be made in the concepts described above by those skilled in the art without departing from the concepts of the present invention. Accordingly, it should be clearly understood that the concepts disclosed in the description are illustrative only and are not intended as limitations on the scope of the invention.

What is claimed is:

1. A method for stimulating the production of hydrocarbons from an underground reservoir penetrated by spaced injection and production systems, comprising:

injecting a miscible flooding medium predominantly composed of a gas selected from the group consisting of carbon dioxide and nitrogen, said flooding medium being injected at a rate to produce a flow velocity in the reservoir of about two to about fifteen times a critical velocity, as defined by the relationship $$V_c=[2.741k\Delta\rho(\sin a)]/\phi\Delta\mu,$$

wherein $V_c$ is the critical velocity in feet per day, k is the permeability of the reservoir in darcies, $\phi$ is the fractional mobile fluid porosity of the reservoir which is $\phi_r(1-S_{wr}-S_{or})$ where $\phi_r$ is the rock porosity, $S_{wr}$ is the residual water saturation, $S_{or}$ is the residual oil saturation, a is the dip angle of the reservoir in degrees, $\Delta\rho$ is the density differential between the displaced fluid and the displacing fluid in grams per cubic centimeter, and $\Delta\mu$ is the viscosity differential between the displaced fluid and the displacing fluid in centipoise; and decreasing the injection rate of the miscible flooding medium to produce a flow velocity in the reservoir less than critical velocity after the flooding medium has traveled about 60% to about 90% of the distance from the injection system to the production system.

2. The method of claim 1, wherein the injection rate is decreased to produce a flow velocity in the reservoir equal to or less than critical velocity after the flooding medium has traveled about 75% to about 90% of the distance from the injection system to the production system.

3. The method of claim 1, wherein the flooding medium is injected at a rate to produce a flow velocity in the reservoir of about three to about four times the critical velocity.

4. The method of claim 1, wherein the underground reservoir has a dip angle of less than about 10°.

5. The method of claim 1, wherein about 1% to about 5% by weight of $C_2$–$C_6$ aliphatic hydrocarbons are injected with the gas of the flooding medium.

6. A method for stimulating the production of hydrocarbons from an underground reservoir with a dip angle of less than 10° penetrated by spaced injection and production systems, comprising:

injecting into the reservoir through the injection system a miscible flooding medium predominantly composed of a gas selected from the group consisting of carbon dioxide and nitrogen, said flooding medium being injected at a rate to produce a flow velocity in the reservoir of about three to about ten times a critical velocity, as defined by the relationship $$V_c=[2.741k\Delta\mu(\sin a)]/\phi\Delta\mu,$$

wherein $V_c$ is the critical velocity in feet per day, k is the permeability of the reservoir in darcies, $\phi$ is the fractional mobile fluid porosity of the reservoir which is $\phi_r(1-S_{wr}-S_{or})$ where $\phi_r$ is the rock porosity $S_{wr}$ is the residual water saturation, $S_{or}$ is the residual oil saturation, a is the dip angle of the reservoir in degrees, $\Delta\rho$ is the density differential between the displaced fluid and the displacing fluid in grams per cubic centimeter, and $\Delta\mu$ is the viscosity differential between the displaced fluid and the displacing fluid in centipoise; and decreasing the injection rate of the miscible flooding medium to produce a flow velocity in the reservoir less than critical velocity after the flooding medium has traveled about 75% to about 90% of the distance from the injection system to the production system.

* * * * *

UNITED STATES PATENT AND TRADEMARK OFFICE

CERTIFICATE OF CORRECTION

PATENT NO. : 4,593,761

DATED : June 10, 1986

INVENTOR(S) : Donald Lawrence Hoyt

It is certified that error appears in the above-identified patent and that said Letters Patent is hereby corrected as shown below:

In Claim 6, the formula at Col. 6, line 35 should appear as follows:

$$V_c = [2.741k\Delta\rho(\sin a)]/\emptyset\Delta\mu$$

Signed and Sealed this

Seventh Day of October, 1986

[SEAL]

*Attest:*

DONALD J. QUIGG

*Attesting Officer*

*Commissioner of Patents and Trademarks*